US005266003A

United States Patent [19]

Warren

[11] Patent Number: 5,266,003

[45] Date of Patent: Nov. 30, 1993

[54] COMPRESSOR COLLECTOR WITH NONUNIFORM CROSS SECTION

[75] Inventor: Matthew R. Warren, Cheektowaga, N.Y.

[73] Assignee: Praxair Technology, Inc., Danbury, Conn.

[21] Appl. No.: 885,860

[22] Filed: May 20, 1992

[51] Int. Cl.[5] ..... F04D 29/44

[52] U.S. Cl. ..... 415/208.3; 415/207

[58] Field of Search ..... 415/182.1, 203, 204, 415/206, 207, 208.1, 208.2, 208.3, 211.2, 212.1

[56] References Cited

U.S. PATENT DOCUMENTS

| | | | |
|---|---|---|---|
| 2,361,521 | 10/1944 | Yates | 415/204 |
| 2,730,861 | 9/1949 | Buchi . | |
| 2,864,552 | 8/1954 | Anderson . | |
| 2,897,917 | 8/1959 | Hunter . | |
| 3,635,579 | 1/1972 | Wood . | |
| 3,922,108 | 11/1975 | Benisek . | |
| 3,961,867 | 7/1976 | Woolenweber . | |
| 4,181,466 | 1/1980 | Owen . | |
| 4,213,742 | 7/1980 | Henshaw | 415/206 |
| 4,240,678 | 12/1980 | Sarle et al. . | |
| 4,381,171 | 4/1983 | Chapple | 415/204 |
| 4,396,348 | 8/1983 | New | 415/203 |
| 4,406,583 | 9/1983 | Becker et al. . | |
| 4,657,480 | 4/1987 | Pfeil . | |
| 4,844,693 | 7/1989 | Grzina | 415/206 |
| 4,859,145 | 8/1989 | Sidraysky . | |
| 4,877,370 | 10/1989 | Nakagawa et al. . | |
| 4,900,225 | 2/1990 | Wulf et al. . | |
| 5,040,947 | 8/1991 | Kajiwara et al. | 415/206 |

*Primary Examiner*—Edward K. Look
*Assistant Examiner*—Christopher Verdier
*Attorney, Agent, or Firm*—Peter Kent

[57] ABSTRACT

A collector for a vaned diffuser in a centrifugal compressor, wherein the radial cross-sectional area of the collector housing at the entrance to the collector outlet duct is 40% to 80% of the entrance area of the outlet duct and progresses smoothly to the outlet duct entrance area. Progression in collector housing cross-sectional area is produced by variation of the collector axial height. At the intersection with the outlet duct, the collector has a step in axial height so as to at least partially direct circumferential flow from the collector into the outlet duct entrance.

10 Claims, 3 Drawing Sheets

COMPRESSOR COLLECTOR WITH NONUNIFORM CROSS SECTION

TECHNICAL FIELD

This invention relates generally to centrifugal compressors which are employed to increase the pressure of a gas, and particularly to the collectors of such centrifugal compressors.

BACKGROUND OF THE INVENTION

Centrifugal compressors have wide application in many industries. In the cryogenic air separation industry, centrifugal compressors are employed to compress the feed air entering the plant where it will be liquified and separated into its constituents. Centrifugal compressors are employed to compress product nitrogen gas and product oxygen gas. The energy required to compress these streams is a major cost in the plant operation. Thus even small improvements in the efficiency of the centrifugal compressors performing the compressions will have a significant effect on the economics of the process.

A conventional centrifugal gas compressor has a rotatable shaft on which is mounted an impeller having blades for ingesting gas in an axial direction. The impeller is rotated thereby accelerating and raising the pressure of the gas. The gas is expelled from the impeller in a radial direction with considerable velocity having a large tangential component. The gas enters a diffuser, where it turns to flow more radially outward, decelerates and continues to rise in static pressure. The diffuser may have vanes to guide the gas flow, or have no vanes, being vaneless, that is, an empty space. In applications where radial compactness is important and efficiency is paramount, a vaned diffuser, being more efficient, is preferred over a vaneless diffuser.

The gas leaves the diffuser with a kinetic energy equal to one to four percent of the energy imparted to the gas by the impeller. The gas velocity leaving the diffuser has both a radial component and a tangential (circumferential) component. A vaned diffuser discharges the gas with a smaller tangential velocity component than a vaneless diffuser.

Encircling the diffuser outlet is a housing with an internal channel having an opening aligned with the diffuser outlet. The channel accepts the gas flow discharging from the circumference of the diffuser. The channel walls direct the gas flow into a tangential direction to flow circumferentially in the channel. The channel accumulates and merges the flow into a single stream which leaves the channel through an outlet duct emerging from the channel housing. Typically the outlet duct emerges from the housing in a tangential direction to minimize flow losses. The outlet duct conveys the compressed gas flow to a pipe which conveys the compressed gas to the next process point.

To accumulate or collect the gas discharging from a vaneless diffuser, an accumulating channel known as a volute is typically used. A conventional volute comprises a housing having a cross section which increases progressively from almost zero area at an origin, known in the art as the tongue, to a maximum area at its outlet, known as the throat. The area schedule requirements result in a small tongue angle, such as 10° as measured from the tangential direction. A volute is usable with a vaneless diffuser, which typically discharges flow with a large tangential component and small exit angle measured from the tangential direction. Thus the flow incidence angle relative to the tongue is low and incidence losses are small. A vaned diffuser typically turns the flow into a more radial direction and discharges flow with a smaller tangential component. Thus the flow from a vaned diffuser on entering a volute would have a greater incidence on the volute tongue with increased dissipation of flow energy.

To avoid incidence losses imposed by the volute tongue, an accumulating channel known as a collector is used with vaned diffusers. A conventional collector comprises a toroidal housing with a constant radial cross-section of sufficiently large area to serve as a plenum to minimize circumferential pressure variation in the collector.

The ordinary collector usually used with a vaned diffuser presents opportunity for improvement. At the circumferential locations at and near the collector origin, which is adjacent to the entrance to the emerging outlet duct, there is little circumferential flow in the collector. There the flow leaving the diffuser decelerates abruptly on entering the collector, with an attendant loss in total pressure. At circumferential locations approaching the end of the collector, that is approaching the outlet duct, considerable circumferential flow accumulates in the collector, and the flow leaving the diffuser accelerates on entering the collector. Subsequently this accelerated flow typically is decelerated, with an attendant loss in total pressure.

On the other hand, where an oversized collector can be accommodated, the flow from a diffuser on entering the collector will decelerate around the entire periphery of the collector, which will result in increased kinetic energy losses. Thus conventional collectors do not well preserve the kinetic energy remaining in the gas exiting vaned diffusers.

SUMMARY OF THE INVENTION

The invention provides a centrifugal compressor comprising:

(a) a rotatable shaft;

(b) an impeller mounted on the shaft;

(c) a vaned diffuser encircling the impeller, the diffuser having an inlet communicating with the discharge of the impeller and an outlet; and (d) a novel collector encircling the impeller.

The collector is a high-efficiency collector for a vaned diffuser and itself is an aspect of the invention comprising:

(a) a housing having a circumferential entrance opening located on the inner-radius wall of the housing, the entrance opening capable of encircling and communicating with the outlet of the vaned diffuser; and (b) an outlet duct emerging from the housing, the outlet duct having an entrance and forming at the entrance a sharp intersection with the outer-radius wall of the housing.

The housing, at a first angular location radially in line with the sharp intersection, has a radial cross-sectional area of from about 40% to about 80% of the entrance area of the outlet duct. In the novel collector, the housing surface axially remote to the housing entrance opening has a step in axial height along the intersection of the outlet duct so as to at least partly direct flow from the housing into the outlet duct and reduce recirculation of flow in the housing.

The housing radial cross-sectional area even in the section of the housing where circumferential flow starts, that is, adjacent to the entrance to the outlet duct, is sufficiently large so as to provide a plenum effect, alleviate sensitivity to entering flow angle and promote swirl.

DETAILED DESCRIPTION OF THE INVENTION

Figure 1:
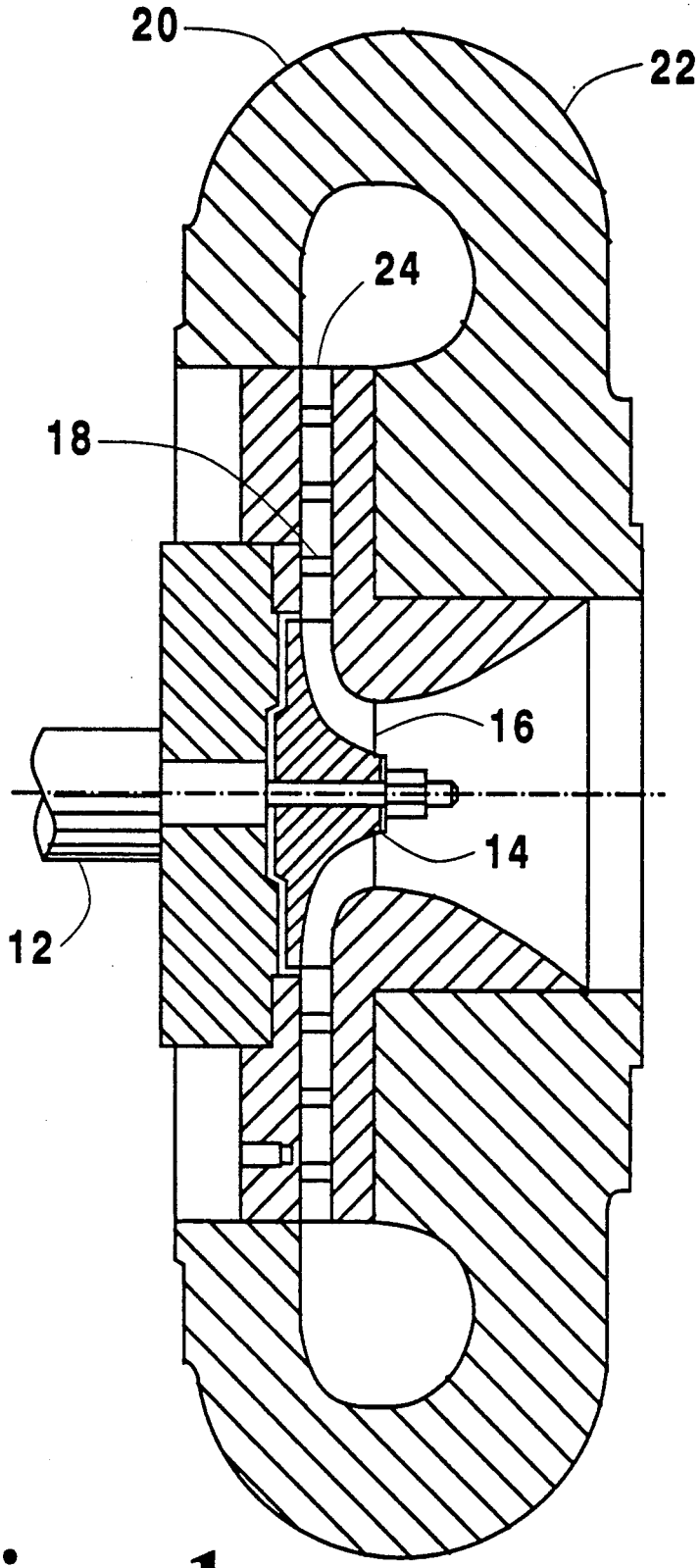
FIG. 1 is an axial view in cross section of a centrifugal compressor embodying the invention.
Figure 2:
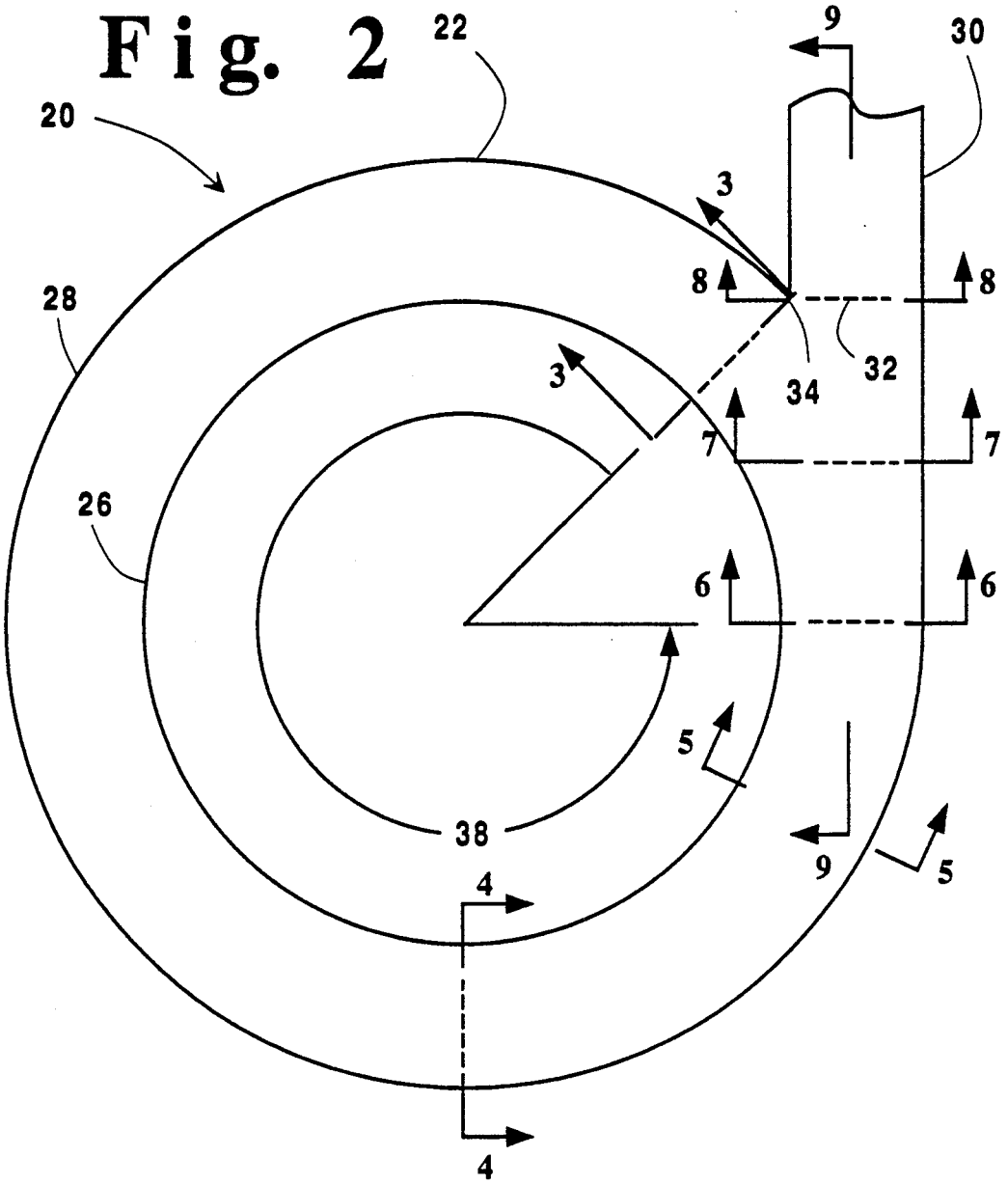
FIG. 2 is a plan view in cross section of the collector in FIG. 1.
Figure 9:
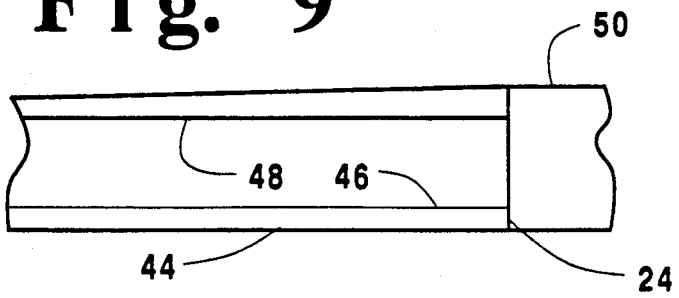
FIGS. 3-9 are each a section of the collector of FIG. 2 taken in the direction of the correspondingly numbered arrows in FIG. 2.

An example of the present invention is illustrated in FIGS. 1-9. In FIG. 1, a centrifugal compressor embodying the invention comprises a rotatable shaft 12 on which is mounted an impeller 14. The impeller has blades 16 for inducing gas to enter the impeller axially and to emerge radially. The impeller discharges into a vaned diffuser 18 encircling the impeller. Encircling the diffuser is a collector 20, as shown in FIG. 2, which includes a generally toroidal housing 22 having radial cross sections at various angular locations, as shown in FIGS. 3-9. The housing 22 has a circumferential entrance opening 24 located on its inner-radius wall 26. The inner-radius wall is that wall portion which faces the central axis of the toroidal housing and lies between the two planes normal to the axis and tangent to the surface of the housing. The entrance opening 24 is capable of receiving the flow from a vaned diffuser intended for use with the novel collector. Preferably, the entrance opening 24 is at one end of the cross-section axial height allowing flow to enter tangential to the housing cross section. Such an entry orientation allows the entering flow to decelerate partially before reaching the outer-radius wall 23 of the collector, thereby converting some of its velocity into static pressure rise. The entering tangential orientation also promotes swirl flow in the collector cross section which sweeps the inner walls of the collector thereby reducing the boundary layer thickness on the walls. This stabilizes the tangential flow in the collector thereby inhibiting separation of flow from the walls and reducing flow friction losses.

Figure 8:
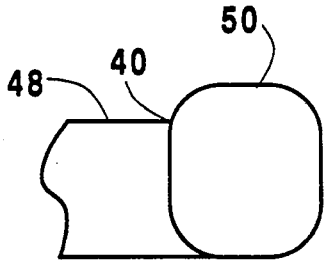

Emerging tangentially from the housing 22 is an outlet duct 30. While the outlet duct need not emerge tangentially, tangential emergence is preferred to reduce flow energy losses. The entrance 32 to the outlet duct, indicated by the arrows 8—8, may have a cross section similiar to that of the housing cross section just upstream of the outlet duct emergence, as shown in FIG. 8, or may be of another shape, for example, circular. The entrance to the outlet duct in volute art is known as the throat. At a circumferential location adjacent to the outlet duct entrance, the outlet duct makes a sharp intersection 34 with the outer-radius wall of the collector. The outlet duct also makes a gradual intersection 36 with the outer-radius wall of the collector. With a tangentially emerging outlet duct, the walls forming the sharp intersection 34 have an included angle of about 60°. The edge of the walls forming the sharp intersection are slightly rounded for manufacturing purposes and to better match flow direction at that location. In volute art, the sharp intersection is known as the tongue. When the outlet duct emerges tangentially, the gradual intersection 36, is itself tangential.

For convenience, a reference angle 38 is defined originating at the radial line from the housing axis passing through the sharp intersection. The reference angle is positive when measured in an initial direction moving away from the gradual intersection, that is, in the direction of the intended circumferential flow in the housing. At a first angular location in line with the sharp intersection, that is, at zero reference angle, the radial cross-sectional area of the housing, denoted by arrows 3—3, is from about 40% to about 80% of the cross-sectional area of the outlet duct entrance 32. This location is the starting point for circumferential flow in the housing. The radial cross-sectional area in this starting section of the housing is of a size that some sudden expansion of the flow entering from the diffuser occurs, but relative to a conventional collector, the expansion is less and the loss is lower. The size of the cross-sectional area in the starting section is large enough, however, and the outer-radius wall of the housing is sufficiently distant from the entrance opening to the housing that, relative to a volute, sensitivity to the entering flow angle is alleviated and thereby flow losses also are reduced.

Figure 5:
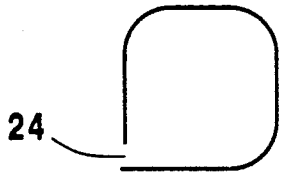

At a second angular location at a reference angle of from about 120° to about 320°, the cross-sectional area of the housing is from about 80% to about 100% of the cross-sectional area of the outlet duct entrance. In FIG. 2, this location is designated by the arrows 5—5 and is shown in FIG. 5.

From the first angular location to the second angular location, the transition of area may follow a linear relationship, or nonlinear relationship, but the transition preferably is smooth, having no decreases and no sudden changes in rate of change, so as to minimize pressure losses in the flow. For instance, at a location intermediate the first and second angular location, such as at the cross section designated by the arrows 4—4 and shown in FIG. 4, the cross-sectional area is intermediate in size to the areas at the first and second angular locations. Smooth as used herein means that the housing walls do not have a total angle of divergence exceeding 15°, steps and discontinuities exceeding 0.01 inches, nor a radius of curvature less than 0.5 inches.

Figure 6:
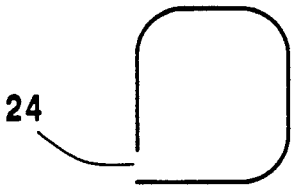

At the last location in the housing where the bulk flow in the housing is completely normal to the radial direction, a third angular location is noted. This location is indicated in FIG. 2 by the arrows 6—6, and is shown in FIG. 6. In one embodiment of the invention, the cross-sectional area of the housing is constant from the second angular location to the third angular location. Then from the third angular location to the outlet, the housing cross-sectional area increases smoothly to that at the outlet.

While one particular schedule of cross-sectional area increase from the first radial location to the outlet duct entrance has been described for illustration, other schedules of area change, such as a linearly increasing area, are usable. It is significant in this invention that the housing cross-sectional area even in the starting section of the housing, that is, adjacent to the outlet duct entrance, is sufficiently large so as to allow the housing to provide a plenum effect with respect to the entering flow from the vaned diffuser. Circumferential pressure variations in the housing are reduced imposing a more uniform pressure at the impeller exit thereby providing increased impeller performance. The cross-sectional area in the starting section of the housing is also sufficiently large so as to promote swirl in the housing. However, compared to a conventional collector, the cross-sectional area is reduced in the starting section so as to reduce flow entering expansion loss in the starting section.

Figure 3:
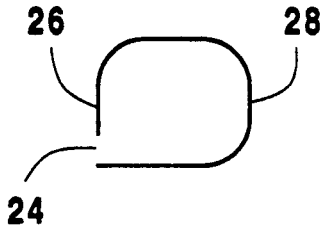
Figure 4:
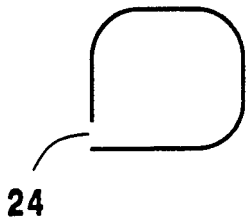

The cross section of the housing at the first angular location, denoted by arrows 3—3, is a square or a rectangle with rounded corners, as shown in FIG. 3. Thus, the outer-radius wall is spaced from the entrance opening to allow some diffusion of the entering flow, to permit the development of swirl in the cross section, and to minimize sensitivity to the angle of the entering flow. The area increase in the cross section from the first radial location to the outlet is accomplished preferably by increasing the axial height of the housing while maintaining the radial width constant. Thus, the cross section progresses from square to rectangular, as shown in FIGS. 3–6. Preferably the ratio of the axial height to the radial width of the housing cross section at the first angular location radially in line with the sharp intersection is from about 0.85 to about 1.25. Other shapes for the cross section of the housing are usable as well, such as, circles, ovals, and other polygons with rounded corners. The polygons need not be regular or equiangular. For example, a parallelogram is usable, such as a parallelogram with an acute included angle of 80°. The radial locations of the centroids of the cross-sectional areas of the housing, relative to the central axis of the housing, are selected so as to increase not more than 20% from that at the first location.

Increasing the height of a cross sectional area of the housing (such as where the cross section is a rectangle) without changing the width of the cross section shifts the centroid of the cross section along and parallel to the housing axis. The centroids move as a point on a helix of constant radius, that is, a curve traced on a cylinder by the rotation of a point crossing its right sections at a constant oblique angle.

With increased cross-sectional area being provided in the housing by increased axial height, the centroids of the cross-sectional areas of the housing are maintained at a constant radius relative to the axis of the housing. This constancy reduces vortex diffusion and pressure variation in the housing thereby promoting increased impeller performance.

Figure 7:
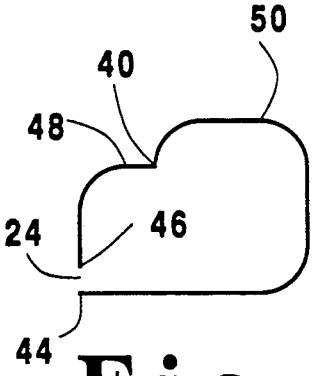

The transition from the housing to the outlet duct is accomplished preferably by a step 40 in the surface removed axially from the entrance opening to the housing, that is, the top surface of the housing as shown in FIGS. 3–7. From some angular location at or greater than that shown by the arrows 6—6, to the location shown by the arrows 8—8, the top surface of the housing is progressively reduced from the height attained at arrows 6—6 to the height at the section shown at arrows 3—3. The transition is shown in FIG. 7 and in FIG. 9. Notable features in these figures are the upper edge 46 of the entrance opening 24, the lower top surface 48 of the housing, and the higher top surface 50 of the housing. The step 40 starts at the location denoted by the arrows 6—6 and progressively increases to the location denoted by the arrows 8—8, that is, to the sharp intersection of the housing. This step at least partly directs the circumferential flow into the outlet duct and reduces the recirculation of circumferential flow in the housing.

While the invention has been described with reference to specific embodiments and examples, it will be appreciated that it is intended to cover all modifications and equivalents within the scope of the appended claims.

What is claimed is:

1. A collector for a vaned diffuser in a centrifugal compressor, said vaned diffuser having an outlet, said collector comprising:

(a) a housing having a circumferential entrance opening, an inner-radius wall, an outer radius wall and an outlet, said entrance opening being located in the inner-radius wall of said housing, and encircling and communicating with the outlet of the vaned diffuser;

(b) an outlet duct emerging from said housing, said outlet duct having an entrance and forming at said entrance a sharp intersection with the outer-radius wall of said housing;

(c) said housing, at a first angular location radially in line with said sharp intersection, having a radial cross-sectional area of from about 40% to about 80% of the radial cross-sectional area of said outlet duct entrance;

(d) said housing having a smooth transition in radial cross-sectional area from said first circumferential location to said outlet duct entrance.

2. The collector as in claim 1 wherein said housing, at a second angular location at a reference angle of from about 120° to about 320° measured from said sharp intersection in the direction of the circumferential flow in said housing has a cross-sectional area equal to from about 90% to about 100% of the area of said outlet duct entrance.

3. The collector as in claim 1 wherein said housing, from said first location to said second location, has a substantially constant radial width and an increasing axial height.

4. The collector as in claim 1 wherein said housing at said first angular location radially in line with said sharp intersection has a cross section with an axial height and a radial width in the ratio of from about 0.85 to about 1.25.

5. The collector as in claim 1 wherein said toroidal housing has a central axis and radial locations of centroids of radial cross-sectional areas of said housing relative to the central axis of said housing increase not more than 20% from that at said first location.

6. The collector as in claim 1 wherein said toroidal housing has a central axis and centroids radial distance from the central axis of said toroidal housing.

7. The collector as in claim 1 wherein the inner-radius wall of said housing has a step in axial height at the intersection of said outlet duct so as to guide flow from said housing into said outlet duct and reduce recirculation of flow in said housing.

8. A centrifugal compressor comprising:

(a) a rotatable shaft;

(b) an impeller having a discharge, said impeller mounted on said shaft;

(c) a vaned diffuser encircling said impeller, said diffuser having an inlet communicating with the discharge of said impeller and an outlet; and (d) a collector encircling said impeller, said collector comprising:

(1) a housing having a circumferential entrance opening, an inner-radius wall, an outer radius wall and an outlet, said entrance opening being located in the inner-radius wall of said housing, and encircling and communicating with the outlet of the vaned diffuser;

(2) an outlet duct emerging from said housing, asid outlet duct having an entrance and forming at said entrance a sharp intersection with the outer-radius wall of said housing;

(3) said housing, at a first angular location radially in line with said sharp intersection, having a radial cross-sectional area of from about 40% to about 80% of the radial cross-sectional area of said outlet duct entrance;

(4) said housing having a smooth transition in radial cross-sectional area from said first circumferential location to said outlet duct entrance.

9. The compressor as in claim 8 wherein said collector housing, from said first location to said second location, has a substantially constant radial width and an increasing axial height.

10. The compressor as in claim 8 wherein said collector housing has a central axis and radial locations of centroids of cross-sectional areas of said housing relative to said central axis of said collector housing increase not more than 20% from that at said first location.

* * * * *